US005813533A

United States Patent [19]

Knoblauch

[11] Patent Number: 5,813,533

[45] Date of Patent: Sep. 29, 1998

[54] STORAGE/DISPLAY BOX FOR DRILL BITS OR THE LIKE

[75] Inventor: Georg Knoblauch, Giengen, Germany

[73] Assignee: Firma Georg Knoblauch, Giengen, Germany

[21] Appl. No.: 805,438

[22] Filed: Feb. 25, 1997

[30] Foreign Application Priority Data

Mar. 22, 1996 [DE] Germany ..... 196 11 301.6

[51] Int. Cl.[6] ..... B65D 85/28

[52] U.S. Cl. ..... 206/379; 206/748; 206/762; 211/69; 312/270.2

[58] Field of Search ..... 206/379, 372, 206/740, 741, 743, 747, 748, 749, 759, 762, 763, 373, 45.23; 211/69, 70.1; 312/270.2, 272, 272.5, 275

[56] References Cited

U.S. PATENT DOCUMENTS 4,006,821 2/1977 Sautter ..... 206/379
4,512,467 4/1985 Knoblauch ..... 206/379
4,660,719 4/1987 Peterson et al. ..... 206/379
4,955,478 9/1990 Rau et al. ..... 206/379

*Primary Examiner*—Paul T. Sewell
*Assistant Examiner*—Nhan T. Lam
*Attorney, Agent, or Firm*—Herbert Dubno; Andrew Wilford

[57] ABSTRACT

A storage/display box for elongated objects has a generally parallepipedal and hollow base having a pair of parallel and spaced side walls, a cover pivotal on the base between a closed position closely engaged over the base and closing same and an open position standing upward therefrom, and a holder fittable in the box and adapted to hold at least one of the objects. A pivot between the holder and the side walls mounts the holder for movement between a down position wholly received in the base and an up position projecting upward therefrom and through an intermediate position between the down and up positions. A spring engaged between the base and the holder is positioned such that it is greatly deformed in the intermediate position and substantially less deformed in the up and down positions.

7 Claims, 4 Drawing Sheets

STORAGE/DISPLAY BOX FOR DRILL BITS OR THE LIKE

FIELD OF THE INVENTION

The present invention relates to a storage/display box. More particularly this invention concerns such a box used to store and display drill bits or other similar elongated objects.

BACKGROUND OF THE INVENTION

As described in my U.S. Pat. No. 4,512,467 a storage/display box for drill bits or the like has a generally parallepipedal and hollow base having a pair of parallel and spaced side walls, a cover pivotal on the base between a closed position closely engaged over the base and closing same and an open position standing upward therefrom, and at least one holder fittable in the box and adapted to hold at least one of the objects. This holder is pivoted on the side walls for movement through somewhat more than 90° between a down position wholly received in the base and an up position projecting upward therefrom and through an intermediate position between the down and up positions.

In order to prevent the box from opening or closing inadvertently, it has been suggested to provide catches or formations that retain the inserts in position. Thus the side of the box can be provided with a bump that rubs against the inserts in the intermediate and raised positions so as to inhibit unwanted movement into these positions and to retain them therein when intentionally placed therein. At best such systems are only moderately effective. They also tend to deform the box when it is opened, making using it more difficult.

OBJECTS OF THE INVENTION

It is therefore an object of the present invention to provide an improved storage/display box for elongated objects.

Another object is the provision of such an improved storage/display box for elongated objects which overcomes the above-given disadvantages, that is which is of very simple construction but where movement out of the up or down positions of the inserts is effectively prevented.

SUMMARY OF THE INVENTION

A storage/display box for elongated objects has according to the invention a generally parallepipedal and hollow base having a pair of parallel and spaced side walls, a cover pivotal on the base between a closed position closely engaged over the base and closing same and an open position standing upward therefrom, and a holder fittable in the box and adapted to hold at least one of the objects. A pivot between the holder and the side walls mounts the holder for movement between a down position wholly received in the base and an up position projecting upward therefrom and through an intermediate position between the down and up positions. According to the invention an elastic deformable formation such as a spring engaged between the base and the holder is positioned such that it is greatly deformed in the intermediate position and substantially less deformed in the up and down positions.

Thus this spring holds the insert or inserts in both the down and the up positions. When in either of the end positions the inserts are clear of the spring so they do not deform it and are not deformed by it. Both on opening and closing of the box the user encounters a brief resistance that is easily overcome, but that is sufficient to retain the inserts in the desired end position.

The base according to the invention can be formed with a deformable bump constituting the elastic deformable formation. Alternately the elastic deformable formation is a curved leaf spring having one end fixed to the base and an opposite end slidable on the base. Either way the spring can be on one of the side walls.

The base has an end wall bridging the side walls and carrying the spring according to another feature of the invention. This spring can be punched out of and unitary with the end wall. The base has a floor and the spring is braced against the floor.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
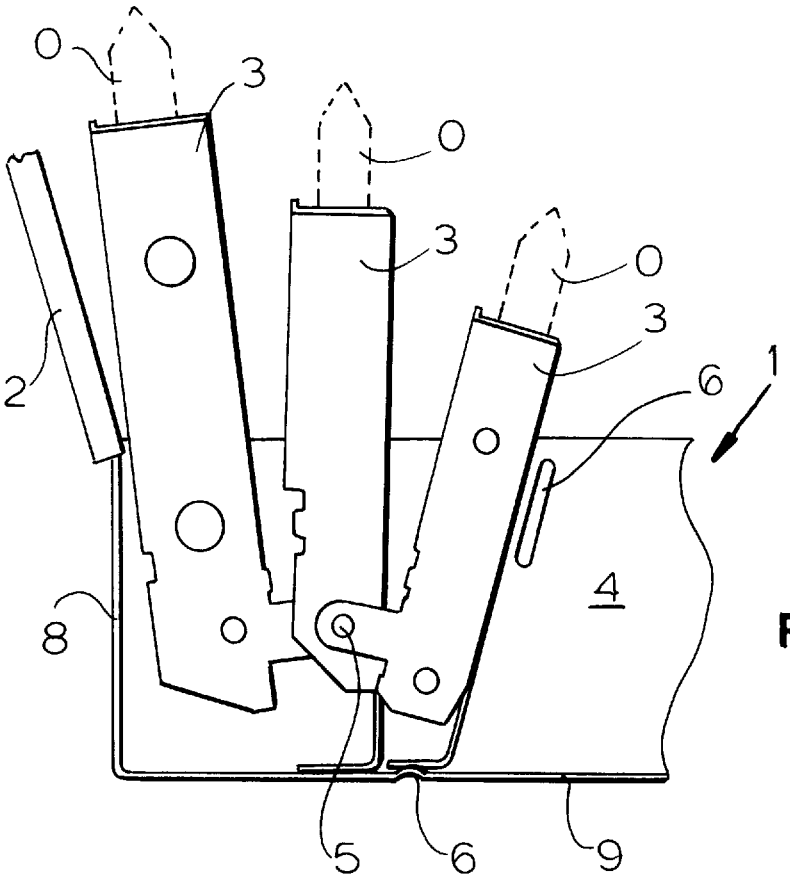
FIG. 1 is a vertical section through a box according to the invention in the open position.

As seen in FIG. 1 a display-storage box according to this invention has a base 1 of parallepipedal shape with a pair of parallel and normally upright side walls 4, a planar floor 9, and an end wall 8 bridging the side walls 4. A generally flat cover 2 is hinged at one end near the end wall 8 and can move between the illustrated up position and an unillustrated down position closing the base 1. Three inserts 3 adapted to hold objects O such as drill bits are mounted on a common pivot 5 extending parallel to the floor 9 between the side walls 4. The base 1, cover 2, and inserts 3 are all stamped out of sheet metal and are of generally standard construction. Normally the cover 2 is linked to the inserts 3 so that raising the cover 2 raises the inserts 3 and lowering the cover 2 lowers the inserts 3.

According to the invention one or both of the side walls 4 is formed with an elastic deformable formation in the form of a bump 6 that rubs against the inserts 3 and is deformed by them as they pass through an intermediate position on the way from the down to the up position and vice versa. Thus this bump 6 prevents these inserts 3 from moving out of either of their end positions.

Figure 2:
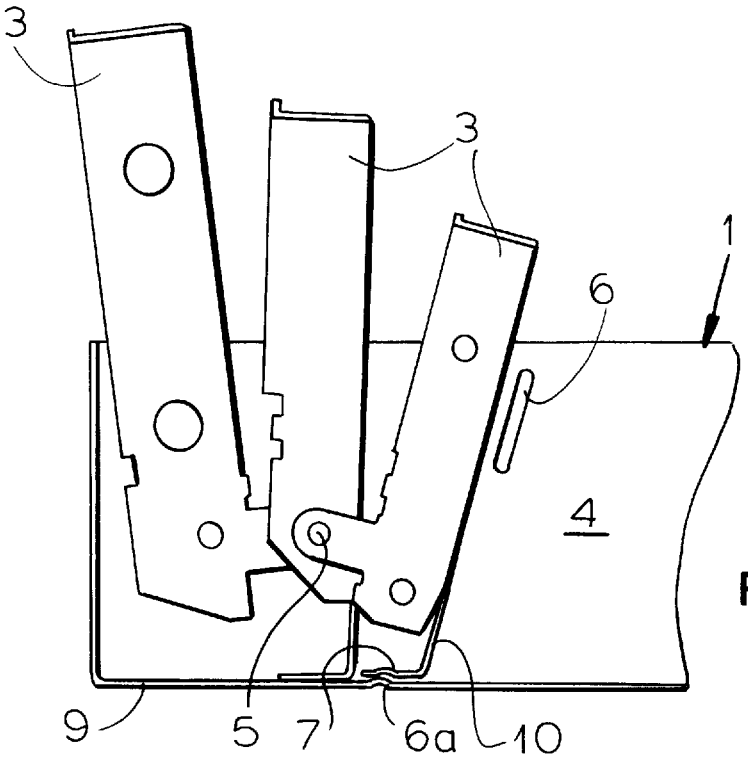
FIG. 2 is a view like FIG. 1 of an alternative to the FIG. 1 box.

In FIG. 2 the floor 9 is provided with a bump **6*a* that interfits with a cavity 7 on a rearwardly projecting arm 10 of one of the inserts 3. In the fully raised position the bump 6*a* fits in the recess 7, retaining the inserts 3** in the raised position.

Figure 3:
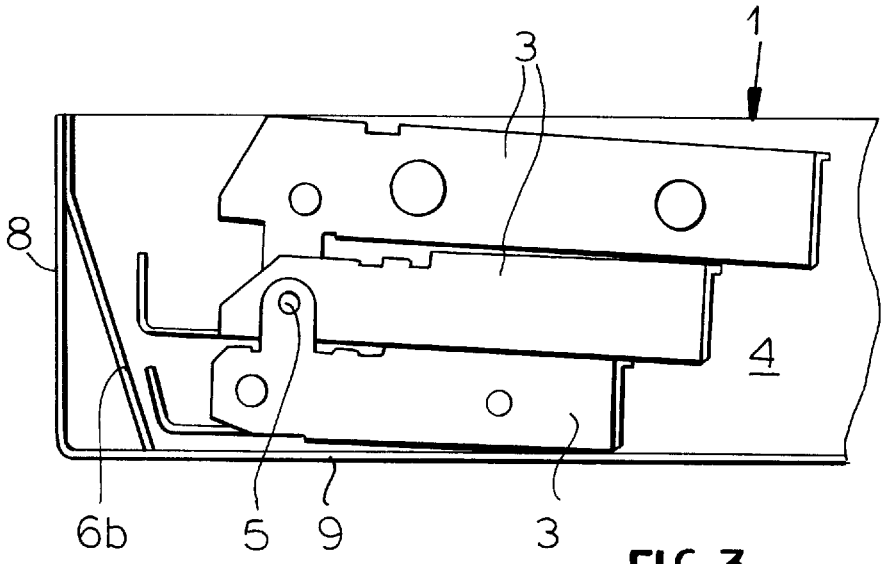
FIGS. 3 and 4 are vertical sections through another box according to the invention in the closed and open positions.
Figure 4:
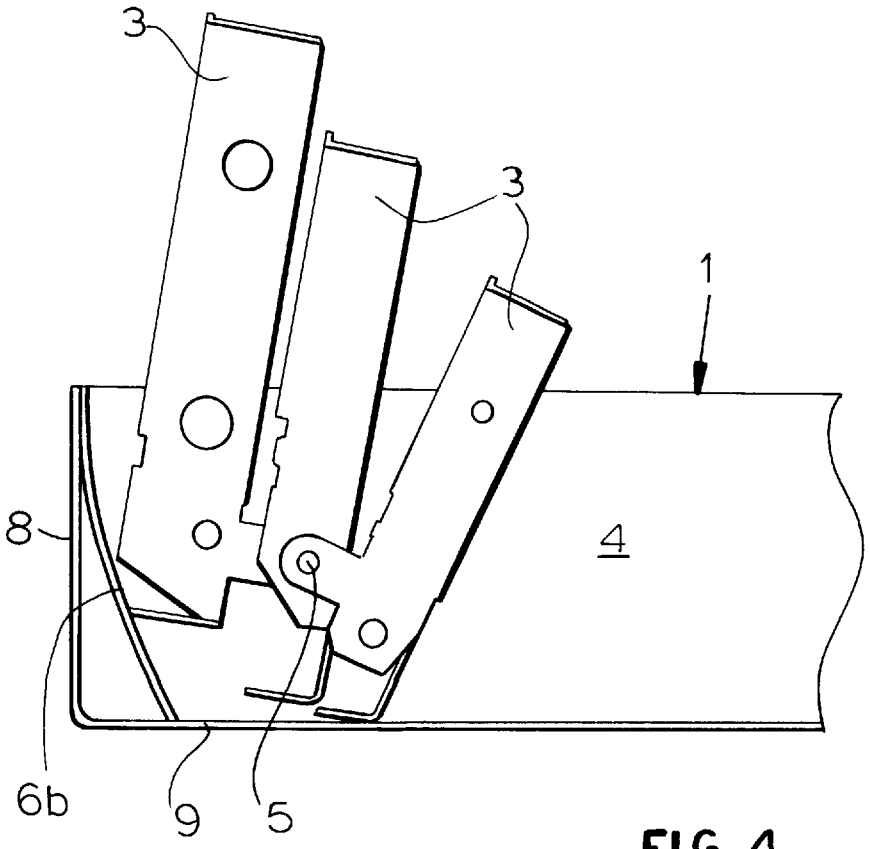
Figure 5:
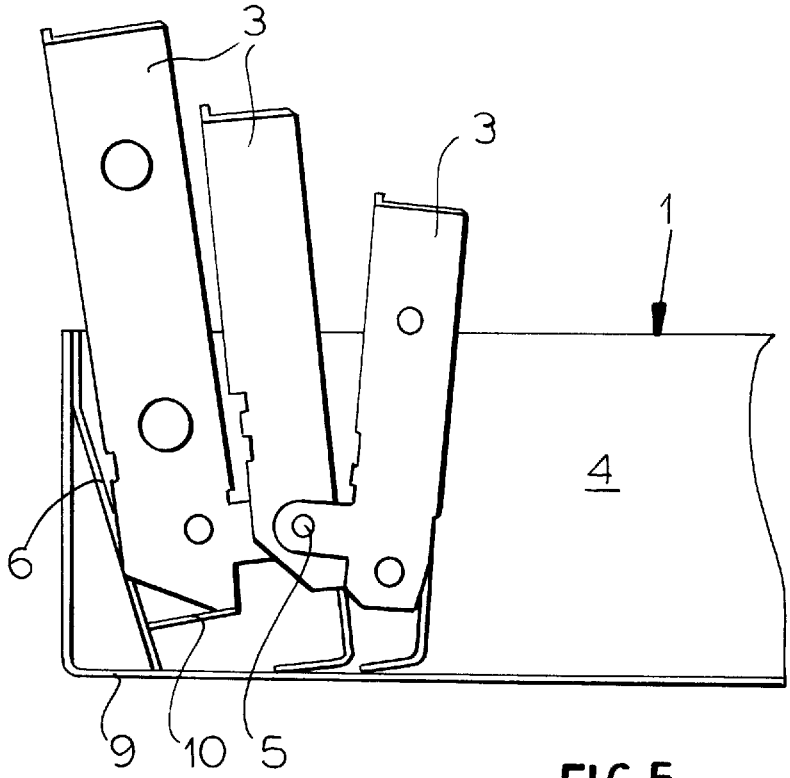
FIGS. 5 and 6 are vertical sections through yet another box in the open and closed positions, respectively.
Figure 6:
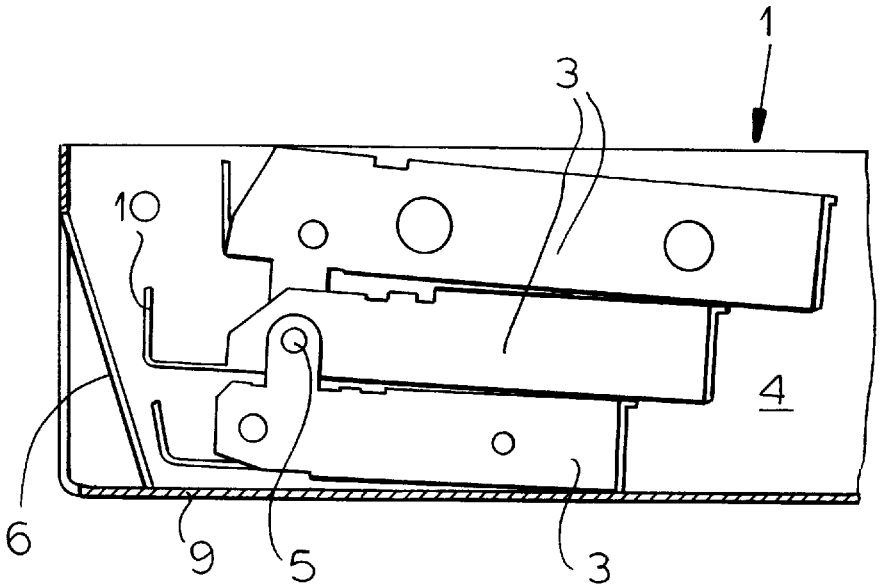
Figure 7:
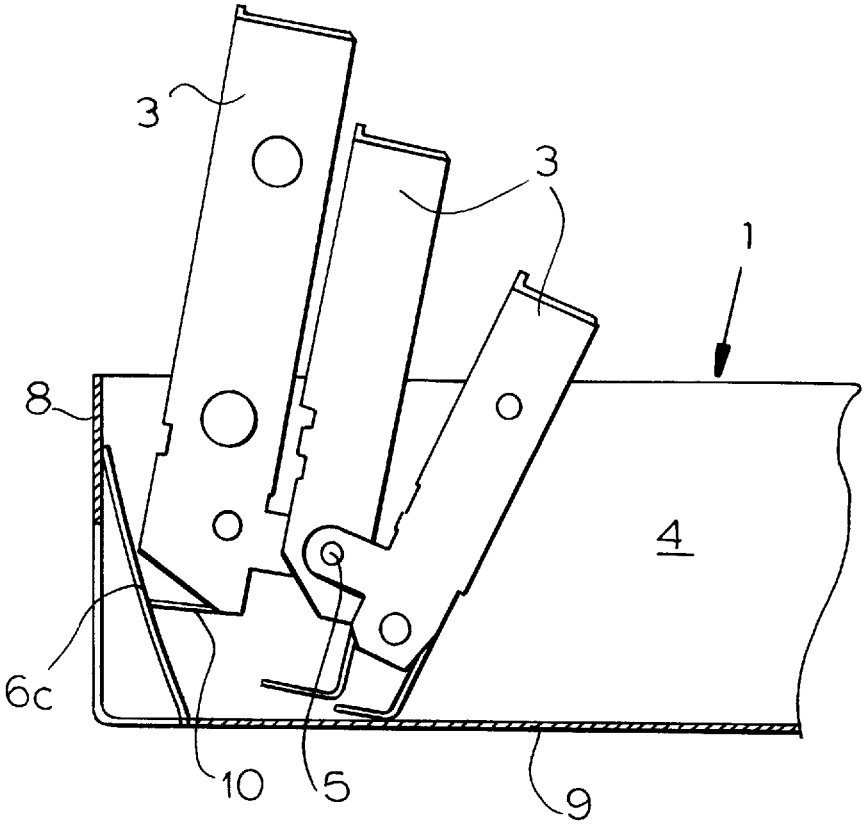
FIG. 7 is a vertical section through a further box according to the invention.

FIGS. 3 and 4 show another arrangement where rearward extensions 10 of the inserts 3 can engage a spring element **6*b* extending at an angle from the back wall 8 down to the floor 9. In FIG. 7 the spring element 6*c* is punched out of the back wall 8**.

Figure 8:
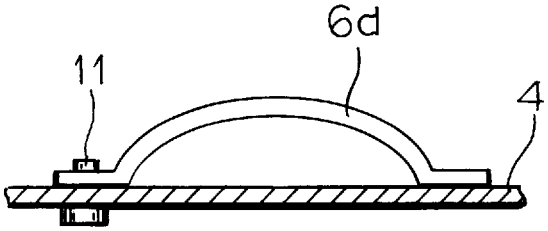
FIG. 8 is a sectional view of a detail of another variant on the box of this invention.

FIG. 8 shows in detail how a curved spring-steel element **6*d* has one end secured by a rivet 11 to one side wall and an opposite free end that can slide on the wall 4. This spring 6***d* is deformed as the inserts 3 move from the down to the up position.

I claim:

1. A storage/display box for elongated objects, the box comprising:

a generally parallepipedal and hollow base having a pair of parallel and spaced side walls;

a cover pivotal on the base between a closed position closely engaged over the base and enclosing the base and an open position standing upward therefrom;

a holder fittable in the box and adapted to hold at least one of the objects;

means forming a pivot between the holder and the side walls for pivoting of the holder between a down position wholly received in the base and an up position projecting upward therefrom and through an intermediate position between the down and up positions; and an elastic deformable formation engaged between the base and the holder and positioned such that it is greatly deformed in the intermediate position.

2. The storage/display box defined in claim 1 wherein the base is formed with a deformable bump thereon constituting elastic deformable formation.

3. The storage/display box defined in claim 1 wherein elastic deformable formation is a curved leaf spring having one end fixed to the base and an opposite end slidable on the base.

4. The storage/display box defined in claim 1 wherein elastic deformable formation is on one of the side walls.

5. The storage/display box defined in claim 1 wherein the base has an end wall bridging the side walls and carrying the elastic deformable formation.

6. The storage/display box defined in claim 5 wherein elastic deformable formation is punched out of and unitary with the end wall.

7. The storage/display box defined in claim 6 wherein the base has a floor and elastic deformable formation is braced against the floor.

* * * * *